United States Patent [19]

Streich et al.

[11] 4,117,429

[45] Sep. 26, 1978

[54] ELECTROMAGNETIC SWITCHING APPARATUS

[75] Inventors: Georg Streich; Johann Bauer, both of Amberg, Germany

[73] Assignee: Siemens Aktiengesellschaft, Berlin and Munich, Germany

[21] Appl. No.: 795,495

[22] Filed: May 10, 1977

[30] Foreign Application Priority Data

May 18, 1976 [DE] Fed. Rep. of Germany ..... 2622100

[51] Int. Cl.[2] ..... H01H 67/02

[52] U.S. Cl. ..... 335/132; 335/197

[58] Field of Search ..... 335/121, 126, 127, 135, 335/197, 132

[56] References Cited

U.S. PATENT DOCUMENTS 3,253,092 5/1966 Landow ..... 335/132 X 3,781,727 12/1973 Pollmann et al. ..... 335/132

FOREIGN PATENT DOCUMENTS 1,258,957 1/1968 Fed. Rep. of Germany ..... 335/132

*Primary Examiner*—George Harris

*Attorney, Agent, or Firm*—Kenyon & Kenyon, Reilly, Carr & Chapin

[57] ABSTRACT

An electromagnetic switching apparatus including a housing, movable contact elements mounted on a plurality of contact bridges in the housing, electrically-connected fixed contact elements disposed on both sides of the contact bridges adapted for contact and electrical connection with the movable contacts and the contact bridges, and electrical insulation means for interrupting the electrical connection between the fixed contact elements and the contact bridges in two terminal positions of the contact bridge carrier. The improvement comprises at least one end of the contact bridges extending outwardly beyond the area of contact between the movable contacts and the fixed contacts. The electrical insulation means are movably supported in the switching apparatus housing so as to be operatively engageable in at least one position with the extended ends of the contact bridges for interrupting the electrical connection between at least one of the contact bridges and the fixed contact elements.

8 Claims, 4 Drawing Figures

ELECTROMAGNETIC SWITCHING APPARATUS

BACKGROUND OF THE INVENTION

1. Field of the Invention

This invention relates generally to an improved electromagnetic switching apparatus including electrical insulation means for interrupting the electrical connection between the fixed contact elements of the switching apparatus and a plurality of contact bridges having movable contacts mounted thereon.

2. Description of the Prior Art

Electromagnetic switching apparatus using contacts which are selectably changeable into "break" and "make" contacts, and comprising a plurality of electrically-interconnected fixed contact elements which cooperate with a plurality of contact bridges on both sides and at each end thereof and electrical insulation means for interrupting the electrical connection between the fixed contact elements and the contact bridges in a pair of end positions of a contact bridge carrier on which the contact bridges are mounted, are known in the art.

For example, in the electromagnetic switching apparatus described in German Auslegeschrift No. 1,490,042, electrical insulation caps are moved into contact with a contact bridge or are designed also as changeable insulation parts which are disposed at the contact point between the fixed contact element and the contact bridge of the switching apparatus. The disadvantage of such an arrangement is that wear at the electrical insulation parts or other effects related to the insulation parts cannot be prevented, and such wear and effects have an adverse effect on the contact surfaces of the fixed contact elements or the contact bridges. As a result, after the insulation caps are changed, the making of the contact as well as the service life of the contact is adversely effected.

SUMMARY OF THE INVENTION

It is therefore an object of the present invention to provide an improved electromagnetic switching apparatus which overcomes the aforementioned disadvantages of heretofore known switching apparatus and in which adverse effects on the contacts caused by changing of the contacts from "break" to "make" contacts, and vice-versa, are eliminated.

It is also an object of the present invention to provide an improved electromagnetic switching apparatus in which changing of the contacts from a "break" to a "make" function can be achieved in a simple manner.

These and other objects of the invention are achieved in an electromagnetic switching apparatus including a housing, movable contact elements mounted on a plurality of contact bridges in the housing, electrically-connected fixed contact elements disposed on both sides of the contact bridges adapted for contact and electrical connection with the movable contacts and the contact bridges, and electrical insulation means for interrupting the electrical connection between the fixed contact elements and the contact bridges in two terminal positions of the contact bridge carrier.

The improvement comprises at least one end of the contact bridges extending outwardly beyond the area of contact between the movable contacts and the fixed contacts. The electrical insulation means is movably supported in the housing so as to be operatively engageable in at least one position with the extended ends of the contact bridges for interrupting the electrical connection between at least one of the contact bridges and the fixed contact elements.

By supporting the electrical insulation means in the switching apparatus housing and by designing the electrical insulation means so that the insulation means can be brought into at least two terminal positions by sliding or, if rotatably mounted, by rotation, the drive or force to effect the change of the contacts may be applied from the outside of the switching apparatus housing so that disassembly of the switching equipment is unnecessary.

The electrical insulation means may comprise movable wedge-shaped electrical insulation members having wedge-shaped starting surfaces. Such a design permits changing of the contact function when the fixed contact elements and contact bridge are disposed in engagement with one another. Also, since changeover of the contact function is usually reciprocally made, the insulation means disposed adjacent each of the extended ends of the contact bridges and the corresponding fixed contact elements are preferably of unitary construction.

The electrical insulation means may further comprise a cylinder rotatably mounted in the switching apparatus housing on which the electrical insulation members of the insulation means are disposed. This design substantially simplifies location of the place at which the electrical insulation means can be actuated in the housing. In this connection, the apparatus preferably further comprises an electrically-conductive U-shaped bracket member on which the fixed contact elements are disposed and on which the cylinder is rotatably mounted. The cylinder also preferably comprises means for rotating the cylinder from a front side of the switching apparatus housing. This design eliminates the need to disassemble the switching equipment to change the contacts from a "break" to a "make" function.

Finally, the insulation means may be designed so that the insulation means can be displaced into operative engagement with the extended ends of the contact bridges by an intermediate part member which is rotatably mounted in the switching apparatus housing and can be secured in a rotated position in which the electrical insulation means is so displaced. This permits the type of contact to be changed without disassembling the switching equipment. In this embodiment of the invention, the contact surface of the extended ends of the contact bridges can be made larger since the axis of rotation of the intermediate part member can extend into the area of the extended contact bridge ends. Furthermore, different material matchings can be selected according to specific requirements.

In order to ascertain whether the contacts are set to "break" or "make" contact without disconnecting the wiring of the switching apparatus, the end face of the cylinder is preferably provided with a position marking which is visible from the front side of the switching apparatus housing.

These and other novel features and advantages of the present invention will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
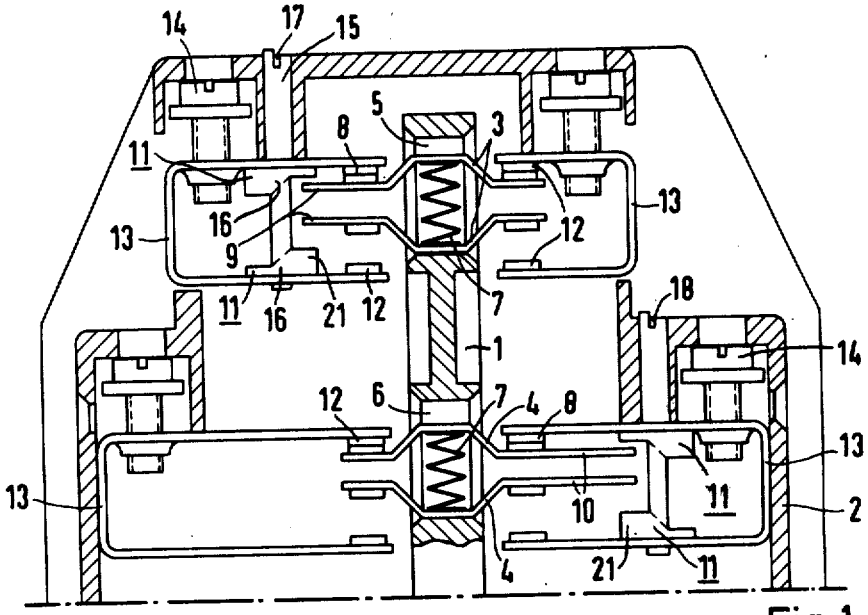
FIG. 1 is a partial, cross-sectional side view of one embodiment of an improved electromagnetic switching apparatus constructed according to the present invention.
Figure 2:
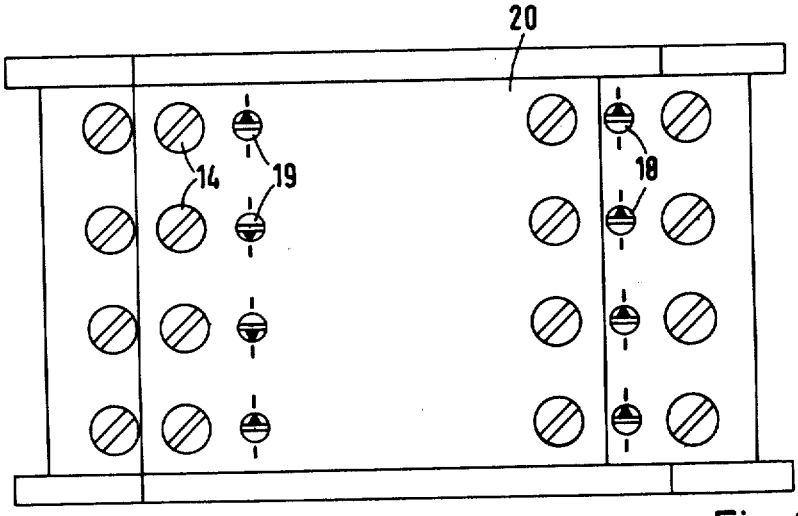
FIG. 2 is a top, plan view of the switching apparatus illustrated in FIG. 1.

Referring now to the drawings, in particular to FIGS. 1 and 2, there is shown an electromagnetic switching apparatus including a contact bridge carrier 1 which is connected in the usual manner with a magnet system (not shown) disposed in the lower part of switching apparatus housing 2. A plurality of contact bridges 3 and 4 are inserted into openings 5 and 6 provided in contact bridge carrier 1 and are spring-loaded by means of springs 7 clamped between the pairs of contact bridges. Contact bridges 3 are disposed in an upper part of the switching apparatus housing and contact bridges 4 are disposed in a lower part of the apparatus housing. The contact bridges include ends 9 and 10 which extend beyond the areas of contact 8 between fixed contact elements 12 and a plurality of movable contact elements disposed on the contact bridges. Electrical insulation means comprising a plurality of electrical insulation members 11 are disposed adjacent the extended ends of the contact bridges and are operatively engageable with the extended ends. Fixed contact elements 12 are disposed above and below contact bridges 3 and 4 on both sides of the associated pairs of contact bridges and are electrically interconnected by means of a U-shaped electrically-conductive bracket member 13. Electrical current is transmitted to the fixed contact elements and bracket 13 by means of terminal screws 14 which are screwed into the current carrying bracket 13. As can be seen from the drawings, brackets 13 have different lengths in the upper and lower parts of the switching apparatus housing. This design permits insulation members 11 in the lower part of the switching apparatus housing to be accessible from the front of the switching apparatus.

In the illustrated embodiment of the invention, the insulation members include cylinders 15 onto which wedge-shaped surfaces 16 are formed. These wedge-shaped surfaces are slidable between extended ends 9 and 10 of the contact bridges and bracket members 13 when the cylinder 15 is rotated. Each of the cylinders 15 is rotatably mounted in bracket members 13 and includes a slot 17 at one end thereof into which a screwdriver or other similar tool can be inserted for effecting a change of the function of the contacts from the front of the switching equipment. It should be noted that changing of the function of the contacts can also be effected by means of a hinged bracket or movable guided part, but that accessibility generally is not as good with such designs. A position marking 19 is provided on the end face 18 of each of the cylinders 15 which, depending upon the position of the cylinder, points to a "make" or a "break" contact symbol provided on the front side 20 of the switching apparatus housing. This arrangement permits the function of the contacts to be visible from the front of the switching apparatus housing.

FIG. 1 illustrates the contacts of the switching apparatus set to provide a "break" contact function. In order to change the contact function to a "make" function, cylinder 15 is rotated so that the wedge-shaped surface 16 of the electrical insulation member 11 engages end 9 of contact bridge 3 and moves the contact bridge away from the fixed contact element at conttact area 8. The contact bridge is then disposed at an angle with respect to the fixed contact elements. The other end of the contact bridge remains in contact with the other fixed contact element at that end of the bridge. Rotation of cylinder 15 as described moves portion 21 of the lower insulation member 11 on cylinder 15 out of the region of end 9 of contact bridge 3. The lower contact bridge 3 then operates as a "make" contact when contact bridge carrier 1 is actuated. Since the upper contact bridge is open and is set to a "break" contact function, the contact arrangement when the cylinder and insulation members are set in this latter described position, provide a "make" contact function.

If the contact bridge carrier is actuated when the insulation members 11 are set as shown in FIG. 1, contact bridges 3 and 4 facing the magnet system of the apparatus will be set at an angle since they will be in operative engagement with parts 21 of the lower electrical insulation members 11. The side of the contact bridges opposite ends 9 and 10 will contact fixed contact elements 12 but no current will flow through the contact bridges so that the function of the contact arrangement will only be a "break" contact function.

Figure 3:
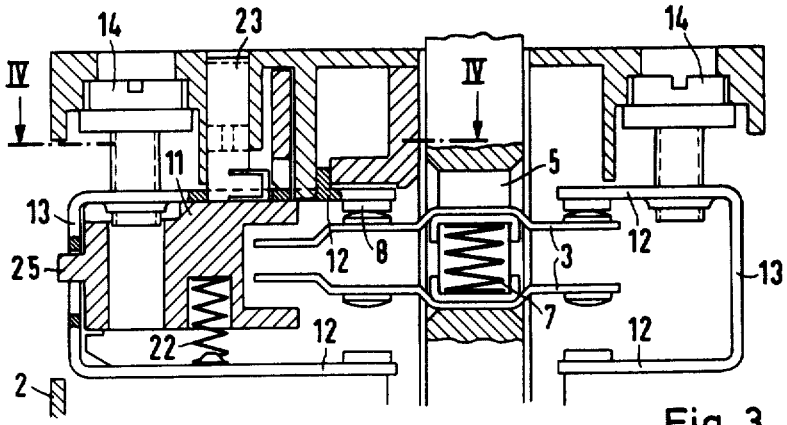
FIG. 3 is a partial, cross-sectional side view of another embodiment of an improved electromagnetic switching apparatus constructed according to the present invention.
Figure 4:
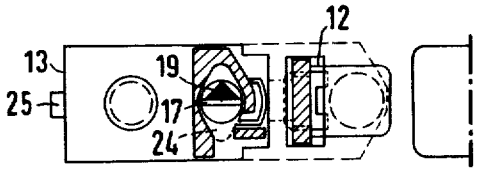
FIG. 4 is a partial, cross-sectional top view of the switching apparatus taken along section IV—IV of FIG. 3.

In the embodiment of the invention illustrated in FIGS. 3 and 4, electrical insulation members 11 are spring-loaded by a spring 22 between the leg portions of bracket members 13 towards the front of the switching apparatus. An intermediate part member 23 is movably held in the switching apparatus housing and is rotatable in the housing so that the intermediate part member and the electrical insulation members can be rotated into the position shown by the dashed lines in the drawings by means of a screwdriver or similar tool inserted into slot 17 provided in the end face of the intermediate part member. After part member 23 is rotated through an angle of 180°, a detent projection 24 will snap behind a projection member fixed to the switching apparatus housing in order to securely hold the intermediate part member in its rotated position. This particular embodiment of the invention permits the use of an additional marking member 25 which extends outwardly through bracket member 13 for indicating the function of the contact arrangement.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In an electromagnetic switching apparatus including a housing, movable contact elements mounted on a plurality of contact bridges in said housing, electrically-connected fixed contact elements disposed on both sides of said contact bridges adapted for contact and electrical connection with said movable contacts and said contact bridges, and electrical insulation means for interrupting the electrical connection between said fixed contact elements and said contact bridges in two terminal positions of said contact bridge carrier, the improvement comprising at least one end of said contact bridges extending outwardly beyond the area of contact between said movable contacts and said fixed contacts, said electrical insulation means being movably supported in said housing so as to be operatively engageable in at least one position with said extended ends of said contact bridges for interrupting the electrical connection between at least one of said contact bridges and said fixed contact elements.

2. The improvement recited in claim 1, wherein said electrical insulation means comprises movable wedge-shaped electrical insulation members.

3. The improvement recited in claim 1, wherein said electrical insulation means comprises a plurality of electrical insulation members disposed adjacent said extended ends of said contact bridges, said insulation members being of unitary construction.

4. The improvement recited in claim 3, wherein said electrical insulation means further comprises a cylinder rotatably mounted in said switching apparatus housing on which said electrical insulation members are disposed.

5. The improvement recited in claim 4, further comprising an electrically-conductive U-shaped bracket member on which said fixed contact elements are disposed, said cylinder being rotatably mounted in said U-shaped bracket member.

6. The improvement recited in claim 4, wherein said cylinder further comprises means for rotating said cylinder from a front side of said switching apparatus housing.

7. The improvement recited in claim 6, wherein said cylinder further comprises a position marking which is visible from the front side of said apparatus housing disposed on an end face of said cylinder.

8. The improvement recited in claim 1, wherein said electrical insulation means further comprises an intermediate part member rotatably mounted in said housing for displacing said electrical insulation means into said operative engagement position, said intermediate part member being secured by detent means in a position in which said electrical insulation means is displaced into said operative engagement position by said intermediate part member.

* * * * *